United States Patent [19]

Ishimaru

[11] Patent Number: 4,596,764

[45] Date of Patent: Jun. 24, 1986

[54] METHOD OF PROCESSING IMAGE-WISE EXPOSED SILVER HALIDE COLOR PHOTOGRAPHIC MATERIAL

[75] Inventor: Shingo Ishimaru, Kanagawa, Japan

[73] Assignee: Fuji Photo Film Co., Ltd., Kanagawa, Japan

[21] Appl. No.: 751,652

[22] Filed: Jul. 3, 1985

[30] Foreign Application Priority Data

Jul. 3, 1984 [JP] Japan ..... 59-137497

[51] Int. Cl.[4] ..... G03C 7/42

[52] U.S. Cl. ..... 430/393; 430/428; 430/430; 430/503; 430/505; 430/539; 430/961; 430/568

[58] Field of Search ..... 430/393, 430, 428, 461, 430/503, 505, 539, 961, 568, 948

[56] References Cited

U.S. PATENT DOCUMENTS

| | | | |
|---|---|---|---|
| 3,772,020 | 11/1973 | Smith | 430/393 |
| 3,893,858 | 7/1975 | Wabnitz | 430/393 |
| 4,448,878 | 5/1984 | Yamamuro et al. | 430/551 |
| 4,458,010 | 7/1984 | Yamamuro et al. | 430/393 |
| 4,546,070 | 10/1985 | Kishimoto et al. | 430/393 |

OTHER PUBLICATIONS

Research Disclosure, May 1977, #15704, p. 8.

*Primary Examiner*—Mary F. Downey
*Attorney, Agent, or Firm*—Sughrue, Mion, Zinn, Macpeak & Seas

[57] ABSTRACT

A method of processing an image-wise exposed silver halide color photographic material is described, having on a support at least one red-sensitive silver halide emulsion layer, at least one green-sensitive silver halide emulsion layer, and at least one blue-sensitive silver halide emulsion layer, the total amount of silver iodide contained in the light-senstive silver halides in said light-sensitive silver halide emulsion layers being higher than $4.0\times10^{-3}$ mole/m$^2$, which comprises processing the color photographic material further containing in a protective layer thereof a super fine grain silver halide, having a mean grain size of less than 0.2 μm and having a silver iodide content of less than 3 mole %, in an amount of from 50 to 140 mole % of the total amount of silver iodide contained in the light-sensitive silver halides, by a color development process including a step subjecting the material to a compound represented by formula (I)

(I)

wherein M represents a hydrogen atom, an alkali metal atom, an alkaline earth metal atom, a quaternary ammonium group, a quaternary phosphonium group, an amidino group, or a group represented by wherein $R^1$ and $R^2$ each represents a hydrogen atom or an aliphatic residue; and m represents an integer of 2 to 4; or a strong acid salt thereof.

18 Claims, No Drawings

METHOD OF PROCESSING IMAGE-WISE EXPOSED SILVER HALIDE COLOR PHOTOGRAPHIC MATERIAL

FIELD OF THE INVENTION

This invention relates to a method of processing an image-wise exposed color photographic materials, and more particularly to an improved fix or blix process for color photographic materials.

BACKGROUND OF THE INVENTION

In general, the fundamental steps of processing processes for silver halide color photographic materials include a color developing step and a silver removing step. That is, when a light-exposed silver halide color photographic material is color-developed, the silver halide is reduced by a color developing agent to form silver and at the same time the oxidized color developing agent reacts with couplers to form dye images. Thereafter, the color photographic material is subjected to a silver removing step, wherein silver formed in the previous step is oxidized by the action of an oxidizing agent (called a bleaching agent), dissolved by a complexing agent for silver ion (generally called a fixing agent), and removed from the photographic material. Thus, dye images only remain in the photographic material. Practical processing processes for color photographic materials include auxiliary steps for keeping the photographic and physical qualities of the dye images and/or improving the stability of the dye images in addition to the above-described steps of color development and silver removal. Examples include a hardening bath for preventing photosensitive emulsion layers of color photographic materials from being excessively softened during processing, a stop bath for effectively stopping the development reaction, an image stabilizing bath for stabilizing dye images, a de-filming bath for removing a backing layer from the support of a color photographic material, etc.

Also, as the above described silver removing step, there is a case of performing silver removal in a single step using a blix bath containing a bleaching agent and a fixing agent, and a case of performing silver removal in two steps using a bleach bath and a fix bath separately.

In general, as a bleaching agent for a bleaching solution, a ferricyanide, potassium bichromate, a ferric ion complex salt, a persulfate, etc., is used. Among the bleaching solutions containing these materials, a bleaching solution containing a ferricyanide has the most excellent bleaching action, but has the disadvantage that a ferricyanide ion and a ferrocyanide ion, which is a reduced form of a ferricyanide, may be discharged by being overflown during processing and being carried in washing water after bleaching, can sometimes form cyan compounds by causing photochemical oxidation, which cyan compounds have a strong toxicity and cause serious environmental pollution problems. Accordingly, the development of excellent and non-toxic bleaching agents for such a ferricyanide has been desired.

A ferric ion complex salt is sometimes used as a bleaching agent in a blix solution for color photographic papers as disclosed, for example, in German Pat. Nos. 866,605 and 966,410, and in U.K. Patent Nos. 746,567, 933,088 and 1,014,396. However, a bleach solution or a blix solution containing a ferric ion complex salt has a weak oxidizing power, and hence when the bleach or blix solution is used for photographing color photographic materials using silver iodibromide and having a high concentration of silver halide, it takes a long period of time for processing.

At any rate, a bleaching process using a metal ion such as a ferricyanide and a ferric ion complex salt is accompanied by the troublesome problem of disposing the waste solution, and hence a bleaching process avoiding use of such a metal ion, i.e., a bleaching process using a persulfate, is more desirable. However, a persulfate also has a disadvantage that the bleaching power thereof is weaker than a ferric ion complex salt, and it thus takes a very long period of time for bleaching. Accordingly, for processing color photographic materials using a large amount of silver halide and having a high sensitivity, a new technique capable of accelerating the bleaching action by a persulfate or a ferric ion complex salt has been desired.

For accelerating the bleaching action of a persulfate or a ferric ion complex salt, a process of adding an amino compound represented by formula (I)

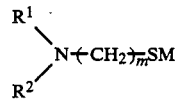

(I)

wherein M represents a hydrogen atom, an alkali metal atom, an alkaline earth metal atom, a quaternary ammonium group, a quaternary phosphonium group, an amidino group, or a group represented by

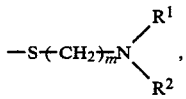

$R^1$ and $R^2$ each represents a hydrogen atom or an aliphatic residue; and m represents an integer of 2 to 4; to the processing bath (a bleach bath, a blix bath or a prebath for use before the bleach or blix bath) is known, as described, for example, in U.S. Pat. Nos. 3,772,020 and 3,893,858; and *Research Disclosure,* RD No. 15704, May, 1977.

However, it has now been clarified to one skilled in the art that when the bleach accelerator shown by above-described formula (I) is used for continuously processing color photographic materials, the bleach accelerator is liable to cause inferior fixing.

That is, when color photographic materials are subjected to a fix treatment in the state that the bleach accelerator is contained in the silver halide emulsion layers in an amount larger than some definite amount, inferior fixing is frequently liable to occur unless the silver ion concentration and the concentrations of iodide ions and other halide ions in the fix solution, as well as other factors having adverse influences on the fixing speed are strictly regulated.

The main factors for determining the concentrations of silver ions and iodide ions remaining in silver halide emulsion layers in a fix solution are the coated amount of silver and the amount of iodine mainly contained in light-sensitive silver halides. Thus, the coating amount of silver in a color photographic material and the composition of light-sensitive silver halide are strictly regulated from the viewpoint of the fixability, which is a very troublesome problem in the production of color photographic materials.

In particular, there has been a trend recently to increase the sensitivity of photographic materials as high as possible, and hence it has now become necessary from a practical viewpoint, to use a silver halide emulsion having a high silver iodide content (higher than about $4.0\times10^{-3}$ mole/m$^2$).

Accordingly, it is urgent need to improve inferior fixing occurring in the case of processing a color photographic material having a high silver iodide content using a bleach accelerator represented by above-described formula (I).

SUMMARY OF THE INVENTION

An object of this invention, therefore, is to provide a means for improving the fixability of a silver halide color photographic material having a high silver iodide content in the case of processing the color photographic material by a color development process including a processing step using a bleach accelerator represented by above-described formula (I).

That is, the particularly object of this invention is to provide a color development process including a step using the bleach accelerator represented by formula (I) which is capable of processing a color photographic material having a high silver iodide content without causing inferior fixing.

As a result of extensive investigations, it has been discovered that the above-described object can be attained according to the present invention as set forth hereinbelow. That is, according to the invention, there is provided a method of processing an image-wise exposed silver halide color photographic material having on a support at least one silver halide emulsion layer, at least one green-sensitive silver halide emulsion layer, and at least one blue-sensitive silver halide emulsion layer, the total amount of silver iodide contained in light-sensitive silver halides in said silver halide emulsion layers being higher than $4.0\times10^{-3}$ mole/m$^2$, which comprises processing the color photographic materials further containing in a protective layer thereof a super fine grain silver halide, having a mean grain size of less than 0.2 $\mu$m and having a silver iodide content of less than 3 mole%, in an amount of from 50 to 140 mole% of the total amount of silver iodide contained in the light-sensitive silver halides by a color development process including a step subjecting the material to the compound represented by formula (I) described above or a strong acid salt thereof (the strong acid is an acid which almost completely dissociates in water).

DESCRIPTION OF PREFERRED EMBODIMENTS

The compound of formula (I) used in this invention is described below in more detail.

In formula (I), M represents a hydrogen atom, an alkali metal atom (e.g., lithium, sodium, potassium, etc.), an alkaline earth metal atom (e.g., calcium, magnesium, etc.), a quaternary ammonium group [having, preferably, 4 to 30 carbon atoms, e.g., $(CH_3)_4N^+$, $(C_2H_5)_4N^+$, $(C_4H_9)_4N^+$, $C_6H_5CH_2N^+(CH_3)_3$, $C_{16}H_{33}N^+(CH_3)_3$, etc.], a quaternary phosphonium group [having, preferably, from 4 to 30 carbon atoms, e.g., $(C_4H_9)_4P^+$, $C_{16}H_{33}P^+(CH_3)_3$, $C_6H_5CH_2P^+(CH_3)_3$, etc.], an amidino group, or a group shown by

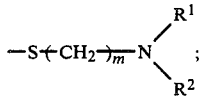

$R^1$ and $R^2$ each represents a hydrogen atom or an aliphatic residue (having, preferably, from 1 to 30 carbon atoms, e.g., an alkyl group or an alkenyl group, particularly preferably an alkyl group having from 1 to 5 carbon atoms; and m is an integer of 2 to 4.

Examples of strong acid salts of the compound represented by formula (I) include hydrochlorides, sulfates, p-toluenesulfonates, methanesulfonates, etc.

Specific examples of the preferred compounds represented by formula (I) are illustrated below as the form of hydrochlorides. Of course, the free compounds of formula (I), other strong acid salts thereof, or metal salts thereof can also be preferably used in this invention.

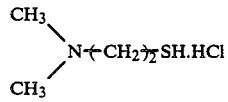

(I)-(1)

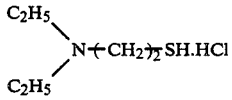

(I)-(2)

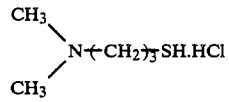

(I)-(3)

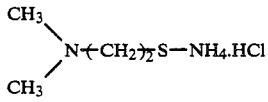

(I)-(4)

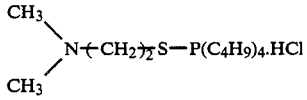

(I)-(5)

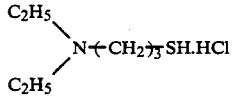

(I)-(6)

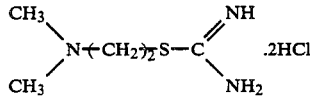

(I)-(7)

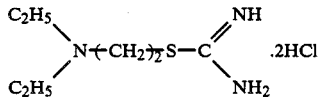

(I)-(8)

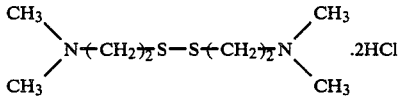

(I)-(9)

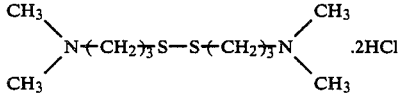

(I)-(10)

The compounds of formula (I), wherein M is an amidino group, can be prepared according to the following reaction.

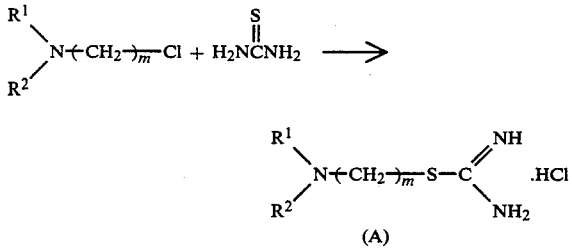

(A)

A compound of formula (I) wherein M is a hydrogen atom can be obtained by hydrolyzing the compound of formula (A). The compounds of formula (I) wherein M is other group than the above group can be obtained by replacing M as a salt of a mercapto group in the case of hydrolyzing the compound of (A) or by oxidizing M.

Some of the reasons for the increase in the fixing speed by the technique of this invention are thought to be as follows.

First, various ions, in particular iodide ions existing in a fixing solution, are trapped by the adsorption or conversion of the super fine grain silver halide existing in the protective layer, whereby the permeation of these ions into silver halide emulsion layers becomes difficult.

Second, particularly, iodide ions and halide ions formed in silver halide emulsion layers during a fix step are trapped in the protective layer by the above-described mechanism to increase the possibility that these iodides diffuse out of the silver halide emulsion layers.

Third, when the compound of formula (I) which is considered to be adsorbed on silver halide in silver halide emulsion layers moves in the silver halide emulsion layers with the progress of fixing of the silver halide, the chance that the compound is adsorbed on the super fine grain silver halide in the protective layer is increased, to increase the possibility that the compound diffuses out of the silver halide emulsion layers rather than the possibility that the compound forms a sparingly soluble complex in the emulsion layers.

The mean grain size of the super fine grain silver halide for use in this invention is less than 0.2 $\mu$m.

Furthermore, the halogen composition of the super fine grain silver halide may be silver chloride, silver chlorobromide, silver chlorobromo-iodide, silver bromide or silver iodobromide, and the iodine content is less than 3 mole%, and preferably less than 2 mole%.

It is necessary that the coating amount of the above-described super fine grain silver halide be from 50 to 140 mole%, and preferably from 75 to 140 mole%, of the total amount of silver iodide contained in the light-sensitive silver halide (i.e., in the silver halide emulsion layers).

It is preferred that the super fine grain silver halide exists in a protective layer for light-sensitive silver halide emulsion layer(s), and when the protective layer is composed of two or more layers, the silver halide may exist in at least one of these layers. In such a case, the silver halide may be incorporated in the optimum layer considering the fixing speed, sensitivity, etc.

The compound represented by formula (I) for use in this invention is used in a bleach bath, a blix bath, or a pre-bath for the bleach or blix bath.

The addition amount of the compound represented by formula (I) for use in this invention depends upon the nature of the processing solution, the kinds of color photographic materials to be processed, the processing temperature, etc., but is preferably from $1\times10^{-5}$ to 1 mole, and more preferably $1\times10^{-4}$ to $1\times10^{-1}$ mole, per liter of the processing solution.

The processing method of this invention can be applied to various kinds of silver halide color photographic materials such as, for example, color positive photographic films, color photographic papers, color negative photographic films, color reversal photographic films (including the case containing a coupler and the case containing no coupler), etc., in particular to color photographic materials having a total silver content of higher than 30 mg/100 cm$^2$, preferably higher than 40 mg/100 cm$^2$. That is, the color photographic materials which are processed by the method of this invention may have various layer structures, but the layer structure to which the method of this invention can be particularly effectively applied is composed of a support having coated thereon, in succession, a colloid silver-containing antihalation layer, (an interlayer), a red-sensitive emulsion layer, (an interlayer), a green-sensitive emulsion layer, a colloid silver-containing yellow filter layer, a blue-sensitive emulsion layer, and a protective layer. In addition, the interlayer in the parenthesis may be omitted as the case may be.

Each of the red-sensitive emulsion layer, the green-sensitive emulsion layer, and the blue-sensitive emulsion layer may be composed of a low-sensitive layer and a high-sensitive layer. Also, at least one of the red-sensitive emulsion layer, the green-sensitive emulsion layer and the blue-sensitive emulsion layer may separated into three partial layers as described in Japanese Patent Publication No. 15495/74, a layer structure composed of a high-sensitive emulsion layer unit and a low-sensitive emulsion layer unit as described in Japanese Patent Application (OPI) No. 49027/76 (the term "OPI" indicates an unexamined published patent application open to public inspection) may be used, and also the layer structures described in West German Patent Application (OLS) Nos. 2,622,922, 2,622,923, 2,622,924, 2,704,826, and 2,704,797 may be used in this invention.

The compound of formula (I) for use in this invention may be incorporated in a layer of a silver halide photographic material, in which a silver salt of the compound is not substantially formed, i.e., a layer containing no silver halide, such as a protective layer, a subbing layer, an interlayer, a yellow filter layer, an antihalation layer, etc. In this case, it is preferred that the compound is incorporated in a layer containing colloid silver.

There is no particular restriction on the addition amount of the compound shown by formula (I) but the amount of the compound is, preferably, from $1\times10^{-7}$ mole to $1\times10^{-3}$ mole, and more preferably from $1\times10^{-6}$ mole to $1\times10^{-4}$ mole per square meter of the layer.

Also, it is preferred to use the compound of formula (I) for the above-described photographic layer together with a compound represented by formula (II)

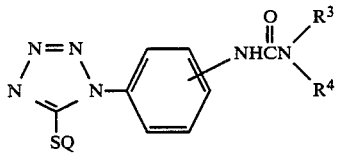

(II)

wherein Q represents a hydrogen atom, an alkali metal atom, or a quaternary ammonium group; and $R^3$ and $R^4$ (which may be the same or different) each represents a hydrogen atom, an unsubstituted or substituted aliphatic group or an unsubstituted or substituted aromatic group, or said $R^3$ and $R^4$ together form a ring.

When the compound of formula (II) is used in the range of from $1\times10^{-2}$ mole to $1\times10^{2}$ moles per mole of silver in the photographic layer, it shows an action of restraining the deviation of the photographic performance, and in particular the increase in fog by colloid silver during the storage of the color photographic material. It is particularly preferred to use the compound of formula (II) in the range of from $1\times10^{-1}$ mole to $1\times10$ moles.

Other stabilizers or antifoggants having the same activity are frequently strongly adhered to silver, thus obstructing the occurrence of silver removal but the compound of formula (II) does not show the action of obstructing the occurrence of silver removal and hence is a very advantageous compound for use in combination with the compound of formula (I).

Specific examples of the compound represented by formula (II) are illustrated below.

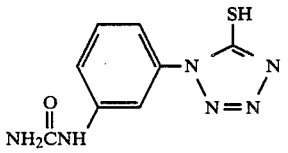

(II)-(1)

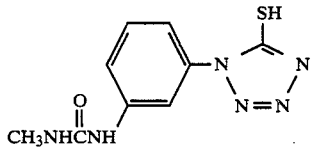

(II)-(2)

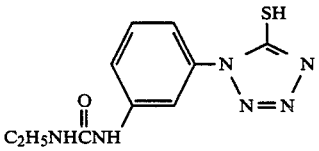

(II)-(3)

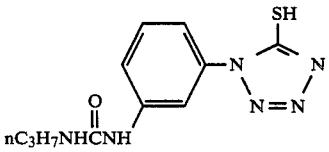

(II)-(4)

Detailed description of the use of the compound of above-described formula (I) and the compound of formula (II) in a color photographic material are set forth, for example, in Japanese Patent Application (OPI) No. 83852/83.

For the silver halide photographic emulsion layers of the color photographic materials which are processed by the method of this invention, silver bromide, silver iodobromide, silver iodochloro-bromide, silver chlorobromide, or silver chloride may be used as the silver halide. There is not particular restriction about the mean grain size (expressed by the diameter of the grains in the case of spherical grains or grains similar to spherical grains or expressed by the mean value based on the projected areas by employing the long side length as the grain size in the case of cubic grains) of the silver halide grains in the silver halide photographic emulsions but the mean grain size is preferably less than 3 μm. The grain size distribution may be broad or narrow.

The silver halide grains in the silver halide photographic emulsions for use in this invention may have a regular crystal form such as a cube or an octahedron or may be an irregular crystal form such as a spherical form or a tabular form, or may be a composite form of these crystal forms. Furthermore, the silver halide grains may be a mixture of grains having various crystal forms.

The silver halide grains may differ in phase between the inside and the surface portion thereof or may be composed of the same phase throughout. Also, the silver halide grains may mainly form latent images on the surface thereof, or may mainly form latent images in the inside thereof.

The super fine grain silver halide emulsions and other light-sensitive emulsions for use in this invention can be prepared by the methods described, for example, in P. Glafkides, *Chimie et Physique Photographique* (published by Paul Montel, 1967), G. F. Duffin, *Photographic Emulsion Chemistry* (published by The Focal Press, 1966), V. L. Zelikman et al, *Making and Coating Photographic Emulsion* (published by The Focal Press, 1964), etc.

That is, the silver halide emulsions may be prepared by an acid method, a neutralization method, an ammonia method, etc., and as the system of reacting a soluble silver salt and a soluble halide, a one-side mixing method, a simultaneous mixing method, or a combination thereof may be used.

Furthermore, a so-called back mixing method, i.e., a method of forming silver halide emulsion in the presence of an excess amount of silver ion, can be used.

As a simultaneous mixing method, a so-called controlled double jet method, i.e., a method of maintaining a constant pAg in a liquid phase in which the silver halide emulsion is formed, can be used. According to the method, a silver halide emulsion having a regular crystal form and substantially uniform grain size can be obtained.

Two or more kinds of silver halide emulsions separately prepared may be used as a mixture of them.

Also, the silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsions for use in this invention may be a negative working silver halide emulsion of the type forming surface latent images or a direct positive reversal silver halide emulsion. Examples of the latter type emulsion include an internal latent image type silver halide emulsion and a previously fogged direct reversal type silver halide emulsion.

Examples of the internal latent image type silver halide emulsions capable of being advantageously used in this invention include conversion type silver halide emulsions, core/shell type silver halide emulsions, silver halide emulsions containing a foreign metal, etc., described, for example, in U.S. Pat. Nos. 2,592,250, 3,206,313, 3,447,927, 3,761,276, and 3,935,014.

Examples of nucleating agents for this type of silver halide emulsion include hydrazines and hydrazones described in U.S. Pat. Nos. 2,588,982, 2,563,785, etc.; quaternary salt compounds described in U.K. Patent No. 1,283,835, Japanese Patent Publication No. 38164/74, U.K. Patents Nos. 3,734,738, 3,719,494, 3,615,615, etc.; sensitizing dyes including a nucleating group having a fogging action in the dye molecule described in U.S. Pat. No. 3,718,470; and acylhydrazinophenylthio urea compounds described in U.S. Pat. Nos. 4,030,925, 4,031,127, etc.

The silver halide emulsions for use in this invention may be used as so-called primitive emulsions without being subjected chemical sensitization, but are usually chemically sensitized. For the chemical sensitization, the methods described in P. Glafkides, *Chimie et Physique Photographique* (published by Paul Montel, 1967), V. L. Zelikman et al, *Making and Coating Photographic Emulsion* (published by The Focal Press, 1964), H. Frieser, *Die Photographischen Prozesse mit Silberhalogeniden* (Akademische Verlagsgesellschaft, 1968), etc., can be used.

Examples include a sulfur sensitizing method using a sulfur-containing compound capable of reacting with a silver ion or active gelatin; a reduction sensitizing method using a reducing material; and a noble metal sensitizing method using a gold compound or other noble metal compound. They can be used singly or as a combination thereof.

Examples of sulfur sensitizers include thiosulfates, thioureas, thiazoles, rhodanines, etc., and specific examples of these compounds are described in U.S. Pat. Nos. 1,574,944, 2,410,689, 2,278,947, 2,728,668, 3,656,955, etc.

Examples of reduction sensitizers include stannous salts, amines, hydrazine derivatives, formamidinesulfinic acid, silane compounds, etc., and specific examples of these compounds are described in U.S. Pat. Nos. 2,487,850, 2,419,974, 2,518,698, 2,983,609, 2,983,610, 2,694,637, etc.

Examples of noble metal sensitizers include complex salts of metals belonging to group VIII of the periodic table, such as platinum, iridium, palladium, etc., in addition to gold complex salts and specific examples of these compounds are described in U.S. Pat. Nos. 2,399,083, 2,448,060; U.K. Pat. No. 618,061, etc.

The silver halide photographic emulsions for use in this invention may be spectrally sensitized by methine dyes, etc. The dyes which are used for this purpose include cyanine dyes, merocyanine dyes, complex cyanine dyes, complex merocyanine dyes, holopolar cyanine dyes, hemicyanine dyes, styryl dyes, and hemioxonole dyes. Particularly advantageous are cyanine dyes, merocyanine dyes, and complex merocyanine dyes.

Useful sensitizing dyes are described, for example, in German Pat. No. 929,080; U.S. Pat. Nos. 2,231,658, 2,493,748, 2,503,776, 2,519,001, 2,912,329, 3,655,394, 3,656,959, 3,672,897, and 3,694,217; U.K. Pat. No. 1,242,588; and Japanese Patent Publication No. 14030/69.

Also, in addition to the layers of silver halide emulsions having light sensitivity as described above, a layer of substantially non-light-sensitive fine grain silver halide emulsion may be formed for improving the graininess and the sharpness or for other purposes. Such a substantially non-light-sensitive fine grain silver halide emulsion layer may be formed on a light-sensitive silver halide emulsion layer or between a light-sensitive silver halide emulsion layer and a colloid silver-containing layer (e.g., a yellow filter layer and an antihalation layer).

The color photographic materials which are processed by the method of this invention may contain a polyalkylene oxide or the derivatives thereof such as the ethers, esters, amines, etc., of the polyalkynene oxide; thioether compounds, thiomorpholines, quaternary ammonium salt compounds, urethane derivatives, urea derivatives, imidazole derivatives, 3-pyrazolidone derivatives, etc., described, for example, in U.S. Pat. Nos. 2,400,532, 2,423,549, 2,716,062, 3,617,280, 3,772,021, 3,808,003, etc.

As a binder for the silver halide emulsion layers and other photographic layers, gelatin is advantageously used in this invention but other hydrophilic colloids may also be used. For example, there are gelatin derivatives; graft polymers of gelatin and other polymers; proteins such as albumin, casein, etc.; cellulose derivatives such as hydroxyethyl cellulose, carboxymethyl cellulose, cellulose sulfuric acid ester, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

Gelatins that can be used include limed gelatin, acid-treated gelatin, and enzyme-treated gelatin as described in *Bull. Soc. Sci. Phot. Japan,* No. 16, p. 30 (1966). Also, the hydrolyzed produces and the enzyme decomposition products of gelatin can be used.

Examples of gelatin derivatives include compounds obtained by reacting gelatin and various compounds such as acid halides, acid anhydrides, isocyanates, bromoacetic acid, alkanesultons, vinylsulfonamides, maleinimide compounds, polyalkylene oxides, epoxy compounds, etc.

The silver halide photographic materials for use in this invention may further contain various compounds as antifoggants (stabilizers). Examples include azoles such as benzothiazolium salts, nitroindazoles, triazoles, benzotriazoles, benzimidazoles (in particular, the nitro derivatives or halogen derivatives), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, etc.; the above-described heterocyclic mercapto compounds further having a water-solubilizing group such as a carboxy group an a sulfone group; thioketo compounds such as oxazolinthion; azaindenes such as tetraazaindenes (in particular, 4-hydroxy-substituted (1,3,3a,7)-tetraazaindenes), etc.; benzenethiosulfonic acids; benzenesulfinic acid, etc.

Detailed specific examples of these compounds and methods of using them are described, for example, in U.S. Pat. Nos. 3,954,474, 3,982,947 and 4,021,248, and Japanese Patent Publication No. 38660/71.

The color photographic materials which are processed by the method of this invention may contain inorganic or organic hardening agents in the silver halide photographic emulsion layers and other layers. Examples of such hardening agents include, for example, chromium salts (chromium alum, chromium acetate, etc.), aldehydes (e.g., formaldehyde, glyoxal, glutaraldehyde, etc.), N-methylol compounds (e.g., dimethylolurea, methyloldimethyl hydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-S-triazine, etc.), mucohalogenic acids (e.g., mucochloric acid, mucophenoxychloric acid, etc.), etc., and they can be used individually or as a combination thereof.

Also, the color photographic materials for use in this invention may further contain in the silver halide photographic emulsion layers and/or other layers various surface active agents for various purposes such as coating aid, static prevention, improvement of slidability, improvement of dispersibility, prevention of adhesion, and improvement of photographic characters (e.g., development acceleration, increase of gradation, and increase of sensitivity).

Examples of these surface active agents include nonionic surface active agents such as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters or polyhydric alcohols, alkyl esters of sugar, etc.; anionic surface active agents having an acid group (e.g., a carboxy group, a sulfo group, a phospho group, a sulfuric acid ester group, a phosphoric acid ester group, etc.), such as alkylcarboxylates, alkylsulfonates, alkylbenzenesulfonates, alkylnaphthalenesulfonates, alkylsulfuric acid esters, alkylphosphoric acid esters, N-acyl-N-alkyltauric acid, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfuric acid esters, aminoalkylphosphoric acid esters, alkylbetanines, amine oxides, etc.; and cationic surface active agents such as alkylamine salts, aliphatic or aromatic quaternary ammonium salts, quaternary ammonium salts (e.g., pyridinium, imidazolium, etc.), phosphonium or sulfonium salts containing an aliphatic or heterocyclic ring, etc.

The color photographic materials for use in this invention contain color-forming couplers, that is, compounds capable of forming colors by the oxidative coupling with an aromatic primary amino color developing agent (e.g., a phenylenediamine derivative, an aminophenol derivative, etc.) in a color development process in the silver halide photographic emulsion layers. Examples of these couplers are magenta couplers such as 5-pyrazolone couplers, pyrazolobenzimidazole couplers, pyrazolopyrazole couplers, pyrazoloimidazole couplers, pyrazolotriazole couplers, pyrazolotetrazole couplers, cyanoacetylcumarone couplers, closed chain acylacetonitrile couplers, etc.; yellow couplers such as acylacetamido couplers (e.g., benzoylacetanilides, pivaroylacetanilides, etc.), etc.; and cyan couplers such as naphthol couplers, phenol couplers, etc.

These couplers are preferably non-diffusible couplers having a hydrophobic group referred to as a "ballast group" in the molecule. The couplers may be or four-equivalent or two-equivalent for silver ion. Also, these couplers may be colored couplers having a color correction effect or may be so-called DIR couplers, i.e., the couplers capable of releasing a development inhibitor with the progress of development. Furthermore, the color photographic materials may contain non-coloring DIR (development inhibitor releasing) coupling compounds, or DIR redox compounds capable of forming a colorless product by a coupling reaction and releasing a development inhibitor in place of DIR couplers.

Specific examples of magenta couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. Nos. 1,810,464; West German Patent Application (OLS) Nos. 2,408,665, 2,417,945, 2,418,959, and 2,424,467; Japanese Patent Publication No. 6031/65; Japanese Patent Application (OPI) Nos. 20826/76, 13041/75, 58922/77, 129538/74, 74027/74, 159336/75, 42121/77, 74028/74, 60233/75, 26541/76, 55122/78, etc.

Specific examples of yellow coloring couplers are described in U.S. Pat. Nos. 2,875,057, 3,265,506, 3,408,194, 3,551,155, 3,582,322, 3,725,072 and 3,891,445, West German Pat. No. 1,547,868; West German Patent Application (OLS) Nos. 2,219,917, 2,261,361, and 2,414,006; U.K. Patent 1,425,020; Japanese Patent Publication No. 107783/72; Japanese Patent Application (OPI) Nos. 26133/72, 73147/73, 102636/76, 6341/75, 123342/75, 130442/75, 21827/76, 87650/75, 82424/77, 115219/77, etc.

Specific examples of cyan couplers are described in U.S. Pat. Nos. 2,369,929, 2,434,272, 2,474,293, 2,521,908, 2,895,826, 3,034,982, 3,311,476, 3,458,315, 3,476,563, 3,583,971, 3,591,383, 3,767,411, and 4,004,020; West German Patent Application (OLS) Nos. 2,414,830 and 2,454,329; Japanese Patent Application (OPI) Nos. 59838/73, 26034/76, 5055/73, 146828/76, 69624/77, 90932/77, etc.

Examples of colored couplers are described in U.S. Pat. Nos. 3,476,560, 2,521,908 and 3,034,892; Japanese Patent Publication Nos. 2016/69, 22335/63, 11304/67 and 32461/69; Japanese Patent Application (OPI) Nos. 26034/76 and 42121/77; West German Patent Application (OLS) No. 2,418,959, etc.

Examples of the DIR couplers include the o-aminoazo type DIR couplers described in U.S. Pat. No. 3,148,062; the thioether type DIR couplers described in U.S. Pat. No. 3,227,554; the 2-benzotriazolyl type couplers described in U.S. Pat. No. 3,617,291; the 1-benzotriazolyl type DIR couplers described in West German Patent Application (OLS) No. 2,414,006; Japanese Patent Application (OPI) Nos. 82424/77, 117627/77, etc.; the nitrogen-containing heterocyclic ring-substituted acetic acid ester type DIR couplers described in Japanese Patent Application (OPI) Nos. 30591/75, 82423/77, etc.; the two-equivalent type DIR cyan couplers described in West German Patent Application (OLS) No. 2,527,652; Japanese Patent Application (OPI) Nos. 146929/76, 90932/77, etc., the malonic diamide type DIR couplers described in Japanese Patent Application (OPI) No. 69624/77, etc.

Examples of the non-coloring DIR coupling compounds include the thioether type cyclic non-coloring DIR compounds described in U.K. Pat. No. 1,423,588; West German Patent Application (OLS) Nos. 2,405,442, 2,523,705, 2,529,350 and 2,448,063; U.S. Pat. No. 3,938,996, etc.; the thioether type cyclic non-coloring DIR compounds described in U.S. Pat. Nos. 3,632,345, 3,928,041, etc.; the benzotriazolyl type non-coloring DIR compounds described in Japanese Patent Application (OPI) Nos. 105819/76, 147716/75, 67628/77, etc.; and the picolinium type DIR coupling compounds described in Japanese Patent Application (OPI) No. 72433/76, etc.

Examples of the DIR redox compounds are the DIR hydroquinones described in U.S. Pat. No. 3,639,417; West German Patent Application (OLS) No. 3,460,202; U.S. Pat. No. 3,297,445, etc., and the DIR redox type couplers described in Japanese Patent Application (OPI) No. 57828/77.

The color photographic materials which are processed by the method of this invention may contain a developing agent as described, for example, in *Research Disclosure, "Developing Agents", Vol.* 176, page 29, Dec. 1978.

The color photographic materials for use in this invention may further contain in the silver halide emulsion layers or other layers dyes for irradiation prevention and other various purposes. Such dyes are described in *Research Disclosure,* "Absorbing and Filter Dyes", Vol. 176, pages 25–26, Dec. 1978.

The color photographic materials in this invention may further contain antistatic agents, plasticizers, matting agents, lubricants, ultraviolet absorbents, optical whitening agents, air fogging preventing agents, etc.

The color photographic material for use in this invention is prepared by coating silver halide emulsion layers and other layers on a support and as the coating method for these layers, the method described in *Research Disclosure,* "Coating Procedure", Vol. 176, pages 27–28 can be employed.

When the method of this invention is applied to color photographic materials such as color negative photographic films, color positive photographic films and color photographic papers after image exposure, the processing method is usually composed of the following fundamental steps.

That is, in the case of using a persulfate as a bleaching agent, the method is composed of (1) color development→step→wash→bleach→acceleration bath→bleach by a persulfate→wash→fix→wash→stabilization→drying.

In the method (1), a pre-bath or a hardening bath may be employed before the color development and the wash step after the stop step and/or the bleach step by the persulfate may be omitted and further the bleach acceleration bath may be omitted as the case may be.

Also, in the case of using a ferric ion complex salt as a bleaching agent, the method is composed of (2) color development→bleach by a ferric ion→complex salt→wash→fix→wash→stabilization→drying.

In the method (2), the wash step after the bleach may be omitted. Also, after fixing, the stabilization may be performed without substantially performing the wash step for simplifying the method. Furthermore, the steps of "bleach→wash→fix" may be performed by one blix step.

On the other hand, when the processing method of this invention is applied to a color reversal photographic film, the process is usually composed of the following fundamental steps.

(3) black and white development→stop→wash→fogging→wash→color development→stop→wash→bleach acceleration→wash→bleaching by a persulfate or a ferric ion complex salt→wash→fix→wash→stabilization→drying.

In method (3), a pre-bath, a pre-hardening bath, a neutralization bath, etc., may be further employed. Also, the wash step(s) after the steps of fogging, bleach acceleration, and/or the bleaching may be omitted. The use of the fogging bath may be replaced by re-exposure, or the fogging treatment may be omitted by adding a fogging agent to the color developer. Furthermore, the bleach acceleration bath may be omitted if desired. Also, the steps "bleach→wash→fix" may be performed by one fix step.

The color developer for use in this invention is composed of an alkaline aqueous solution containing a color developing agent. Examples of color developing agents include known primary aromatic amino color developing agents, for example, phenylenediamines such as 4-amino-N,N-diethylaniline, 3-methyl-4-amino-N,N-diethylaniline, 4-amino-4-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-β-methoxyethylaniline, etc.).

Other color developing agents described in L. F. A. Mason, *Photographic Processing Chemistry* (published by The Focal Press, 1966), pages 226–229; U.S. Pat. Nos. 2,193,015 and 2,592,364; Japanese Patent Application (OPI) No. 64933/73, etc. may be used.

The color developer may further contain a pH buffer such as a sulfite, a carbonate, a borate, or a phosphate of an alkali metal and/or a development inhibitor or an anti-foggant such as a bromide, an iodide, and organic antifoggants.

The color developers for use in this invention may further contain, if desired, water softeners; preservatives such as hydroxylamine, etc.; organic solvents such as benzyl alcohol, diethylene glycol, etc.; development accelerators such as polyethylene glycol, quaternary ammonium salts, amines, etc.; dye-forming couplers; completing couplers; auxiliary developing agents such as 1-phenyl-3-pyrazolidone, etc.; tackifiers; the polycarboxylic acid series chelating agents described in U.S. Pat. No. 4,083,723; and the antioxidants described in West German Patent Application (OLS) No. 2,622,950.

For the bleach solution or the blix solution for use in the processing method of this invention, a weak bleaching agent having a weak bleaching power is preferably used. A ferric ion complex salt which is one of such bleaching agent is a complex salt of a ferric ion and a chelating agent such as aminopolycarboxylic acid, aminopolyphosphoric acid, and the salts of these acids, such as the alkali metals salts, ammonium salts, and water-soluble amine salts of aminopolycarboxylic acid or aminopolyphosphoric acid. Examples of the alkali metal include sodium, potassium, lithium, etc.; and water-soluble amines, there are alkylamines such as methylamine, diethylamine, triethylamine, butylamine, etc., alicyclic amines such as cyclohexylamine, etc., arylamines such as aniline, m-toluidine, etc., and heterocyclic amines such as pyridine, morpholine, piperidine, etc.

Typical examples of the chelating agents such as aminopolycarboxylic acid, aminopolyphosphoric acid, and the salts of these acids are as follows:

ethylenediaminetetraacetic acid,
ethylenediaminetetraacetic acid,
ethylenediaminetetraacetic acid di-ammonium salt,
ethylenediaminetetraacetic acid tetra(trimethylammonium) salt,
ethylenediaminetetraacetic acid tetrapotassium salt, ethylenediaminetetraacetic acid tetrasodium salt,
ethylenediaminetetraacetic acid trisodium salt,
diethylenetriaminepentaacetic acid,
diethylenetriaminepentaacetic acid pentasodium salt,
ethylenediamine-N-(β-oxyethyl)-N,N',N'-triacetic acid,
ethylenediamine-N-(β-oxyethyl)-N,N',N'-triacetic acid trisodium salt,
ethylenediamine-N-(β-oxyethyl)-N,N',N'-triacetic acid triammonium salt,
propylenediaminetetraacetic acid,
propylenediaminetetraacetic acid disodium salt,
nitrilotriacetic acid,
nitrilotriacetic acid trisodium salt,
cyclohexanediaminetetraacetic acid,
cyclohexanediaminetetraacetic acid disodium salt,
iminodiacetic acid,
dihydroxyethylglycine,
ethyl ether diaminetetraacetic acid,
glycol ether diaminetetraacetic acid,
ethylenediaminetetrapropionic acid,
phenylenediaminetetraacetic acid,
1,3-diaminopropanol-N,N,N',N'-tetramethylenephosphonic acid,
ethylenediamine-N,N,N',N'-tetramethylenephosphonic acid,
1,3-propylenediamine-N,N,N',N'-tetramethylenephosphonic acid, etc.

Of course, chelating agents other than the above-described compounds can also be used in this invention.

The ferric ion complex salt may be used in the form of complex salt from the first or the ferric ion complex salt may be formed in a solution using a ferric salt such as ferric sulfate, ferric chloride, ferric nitrate, ferric ammonium sulfate, ferric phosphate, etc., and a chelating agent such as an aminopolycarboxylic acid, an aminopolyphosphonic acid, a phosphonocarboxylic acid, etc.

In the case of use in the form of the complex salt, one kind of complex salt may be used, or two or more kinds of complex salts may be used. Also, in the case of forming the complex salt using a ferric salt and a chelating agent, one kind of the ferric salt or two or more kinds of ferric salts may be used. Furthermore, one kind or two or more kinds of chelating agents may be used. Also, in these cases, the chelating agent(s) may be used in a more than necessary amount for forming the ferric ion complex salt.

Also, the bleach solution of blix solution containing the above-described ferric ion complex salt may further contain a complex salt of other metal ion than iron ion, such as cobalt ion, copper ion, etc.

Examples of persulfate which can be used for the bleach solution or the blix solution in this invention include alkali metal persulfates such as potassium persulfate, sodium persulfate, etc., and ammonium persulfate. In this invention, a weak bleaching agent having a weak bleaching power is preferably used, and in such a case, the use of the persulfate is particularly effective in this invention.

The preferred amount of the aforesaid bleaching agent is from about 0.05 to 2 moles per liter of the bleach solution.

The bleach solution for use in this invention may further contain a chloride such as potassium chloride, sodium chloride, ammonium chloride, etc., or a bromide such as potassium bromide, sodium bromide, ammonium bromide, etc. However, in the case of using a persulfate, the bromide is not used because the bromide generates a bromine gas in such a case. Also, the bleach solution may further contain one or more kinds of inorganic or organic acids having a pH buffering capability thereof or the salts, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc. Also, the concentration of the salt in the bleach solution can be controlled by the addition of a salt such as sodium sulfate, potassium sulfate, etc.

Moreover, the bleach solution using the persulfate may further contain an imido compound in an amount of about $2\times10^{-6}$ to $1\times10^{-1}$ mole, and preferably from $1\times10^{-2}$ to $4\times10^{-2}$ mole per liter of the bleach solution for preventing the generation of halogen gases.

It is preferred that the pH of the bleach solution be from about 1.0 to 8.0, and preferably from 1.5 to 7.5.

For the bleach solution, the blix solution or a solution for a pre-bath can be used various bleach accelerators together with the compound represented by the formula (I) described above. Examples of these bleach accelerators are the mercapto compounds and the dithiocarbamate compounds described, for example, in U.S. Pat. No. 3,707,374; Japanese Patent Publication No. 28227/76; Japanese Patent Application (OPI) Nos. 94027/78, 95631/78, 97980/78, 98801/78, etc.

On the other hand, in the case of using the compound represented by above-described formula (I) for the blix solution, an ordinary fixing agent such as thiosulfates (e.g., sodium thiosulfate, ammonium thiosulfate, ammoniumsodium thiosulfate, potassium thiosulfate, etc.); thiocyanates (e.g., sodium thiocyanate, ammonium thiocyanate, potassium thiocyanate, etc.); thio ethers (e.g., ethylenebisthioglycolic acid, 3,6-dithia-1,8-octanediol, etc.); and water-soluble silver halide solvents (e.g., thioureas, etc.). They can be used individually or as a mixture thereof.

Furthermore, the specific blix solution composed of a fixing agent and a large amount of a halogen compound such as potassium iodide as described in Japanese Patent Application (OPI) No. 155354/80 can be used in this invention.

For the amount of each component in the fix composition for use in this invention, it is preferred that the amount of the ferric ion complex salt is from 0.1 to 2 moles and the amount of fixing agent is from 0.2 to 4 moles per liter of the blix solution.

The blix solution for use in this invention may further contain the additives and preservatives as described above for the bleach solution, such as sulfites (e.g., sodium sulfite, potassium sulfite, ammonium sulfite, etc.); hydroxylamine; hydrazine; and hydrogensulfite addition product of an aldehyde compound (e.g., an addition product of sodium hydrogensulfite and acetaldehyde, etc.). Furthermore, the blix solutions may further contain various kinds of optical whitening agents, defoaming agents, surface active agents, organic solvents such as methanol, etc., and known compounds having a blixing accelerating property, such as, for example, the polyamine compounds described in Japanese Patent Publication No. 8836/70; the thiourea derivatives described in Japanese Patent Publication No. 8506/70; the iodides described in German Pat. No. 1,127,714; the polyethylene oxides described in German Pat. No. 966,410; the nitrogen-containing heterocyclic compounds described in German Pat. No. 1,290,812; and other thioureas. Also, the pH of the blix solution is usually from about 4.0 to 9.0, and preferably from about 5.0 to 8.0.

Ordinary compositions generally used as fix solutions can be used. As a fixing agent, thiosulfates, thiocyanates as well as inorganic sulfur compounds which are known to have an effect as a fixing agent can be used. The fix solution may further contain a water-soluble aluminum salt as a hardening agent.

The following examples are intended to illustrate the present invention, but not to limit it in any way.

EXAMPLE 1

A multilayer color photographic material, Sample 101 was prepared by forming on a cellulose triacetate film support the layers having the following compositions in the order:

A 1st Layer: Antihalation Layer:
- A gelatin layer containing 0.18 g/m$^2$ of black colloid silver, 0.16 g/m$^2$ of ultraviolet absorbent C-1, and 0.77 g/m$^2$ of ultraviolet absorbent C-2.

A 2nd Layer: Interlayer:
- A gelatin layer containing 0.18 g/m$^2$ of compound H-1 and 0.15 g/m$^2$ (as silver coverage) of a silver iodobromide emulsion (silver iodide: 1 mole%, mean grain size: 0.07$\mu$).

A 3rd Layer: 1st Red-Sensitive Emulsion Layer:
- A gelatin layer containing 0.72 g/m$^2$ (as silver coverage) of a silver iodobromide emulsion (silver iodide: 6 mole%, mean grain size: 0.5$\mu$), $7.0\times10^{-5}$ mole (per mole of silver) of sensitizing dye I, $2.0\times10^{-5}$ mole (per mole of silver) of sensitizing dye II, $2.8\times10^{-4}$ mole (per mole of silver) of sensitizing dye IV, 0.35 g/m$^2$ of coupler C-3, 0.01 g/m$^2$ of coupler C-4, and 0.01 g/m$^2$ of coupler C-5.

A 4th Layer: 2nd Red-Sensitive Emulsion Layer:
- A gelatin layer containing 1.2 g/m$^2$ (as silver coverage) of a silver iodobromide emulsion (silver iodide: 10 mole%, mean grain size: 1.2$\mu$) $5.2\times10^{-5}$ mole (per mole of silver) of sensitizing dye I, $1.5\times10^{-5}$ mole (per mole of silver) of sensitizing dye II, $2.1\times10^{-4}$ mole (per mole of silver) of sensitizing dye III, $1.5\times10^{-5}$ mole (per mole of silver) of sensitizing dye IV, 0.20 g/m$^2$ of coupler C-3, 0.01 g/m$^2$ of coupler C-4, and 0.01 g/m$^2$ of coupler C-5.

A 5th Layer: 3rd Red-Sensitive Emulsion Layer:
- A gelatin layer containing 2.0 g/m$^2$ (as silver coverage) of a silver iodobromide emulsion (silver iodide: 10 mole%, mean grain size: 1.8$\mu$) $5.5\times10^{-5}$ mole (per mole of silver) of sensitizing dye I, $1.6\times10^{-5}$ mole (per mole of silver) of sensitizing dye II, $2.2\times10^{-5}$ mole (per mole of silver) of sensitizing dye III, $1.6\times10^{-5}$ mole (per mole of silver) of sensitizing dye IV, and 0.10 g/m$^2$ of coupler C-3.

A 6th Layer: Interlayer:
- A gelatin layer containing 0.02 g/m$^2$ of compound H-1.

A 7th Layer: 1st Green-Sensitive Emulsion Layer:
- A layer containing 0.55 g/m$^2$ (as silver coverage) of a silver iodobromide emulsion (silver iodide: 5 mole%, mean grain size: 0.4$\mu$), $3.8\times10^{-4}$ mole (per mole of silver) of sensitizing dye V, $3.0\times10^{-5}$ mole (per mole of silver) of sensitizing dye VI, 0.29 g/m$^2$ of coupler C-6, 0.04 g/m$^2$ of coupler C-7, 0.04 g/m$^2$ of coupler C-8, and 0.01 g/m$^2$ of coupler C-4.

An 8th Layer: 2nd Green-Sensitive Emulsion Layer:
- A gelatin layer containing 1.0 g/m$^2$ (as silver coverage) of a silver iodobromide emulsion (silver iodide: 10 mole%, mean grain size: 1.2 $\mu$m), $2.7\times10^{-4}$ mole (per mole of silver) of sensitizing dye V, $2.1\times10^{-5}$ mole (per mole of silver) of sensitizing dye VI, 0.04 g/m$^2$ of coupler C-9, 0.001 g/m$^2$ of coupler C-7, and 0.001 g/m$^2$ of coupler C-8.

A 9th Layer: 3rd Green-Sensitive Emulsion Layer:
- A gelatin layer containing 1.5 g/m$^2$ (as silver coverage) of a silver iodobromide emulsion (silver iodide: 10 mole%, mean grain size: 1.8 $\mu$m), $3.0\times10^{-4}$ mole (per mole of silver) of sensitizing dye C, $2.4\times10^{-5}$ mole (per mole of silver) of sensitizing dye (per mole of silver) of sensitizing dye VI, 0.03 g/m$^2$ of coupler C-9, and 0.001 g/m$^2$ of coupler C-8.

A 10th Layer: Yellow Filter Layer:
- A gelatin layer containing 0.054 g/m$^2$ of yellow colloid silver, 0.20 g/m$^2$ of compound H-1, and 0.001 g/m$^2$ of compound II-(2).

An 11th Layer: 1st Blue-Sensitive Emulsion Layer:
- A gelatin layer containing 0.32 g/m$^2$ (as silver coverage) of a silver iodobromide emulsion (silver iodide: 5 mole%, mean grain size: 0.3 $\mu$m), 0.68 g/m$^2$ of coupler C-10, and 0.03 g/m$^2$ of coupler C-4.

A 12th Layer: 2nd Blue-Sensitive Emulsion Layer:
- A gelatin layer containing 0.29 g/m$^2$ (as silver coverage) of a silver iodobromide emulsion (silver iodide: 10 mole%, mean grain size: 0.8 $\mu$m) and 0.22 g/m$^2$ of coupler C-10.

A 13th Layer: 3rd Blue-Sensitive Emulsion Layer:
- A gelatin layer containing 0.79 g/m$^2$ (as silver coverage) of a silver iodobromide emulsion (silver iodide: 14 mole%, mean grain size: 1.8 $\mu$m), $2.3\times10^{-4}$ mole (per mole of silver) of sensitizing dye VII and 0.19 g/m$^2$ of coupler C-10.

A 14th Layer: 1st Protective Layer:
- A gelatin layer containing 0.20 g/m$^2$ of ultraviolet absorbent C-1 and 0.90 g/m$^2$ of ultraviolet absorbent C-2.

A 15th Layer: 2nd Protective Layer:
- A gelatin layer containing 0.05 g/m$^2$ of polymethyl methacrylate particles (diameter: 1.5 $\mu$m).

Each of the above-described layers further contained a gelatin hardening agent C-11 and a surface active agent in addition to the above components.

The compounds used for preparing Sample 101 were as follows.

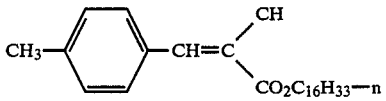

C-1

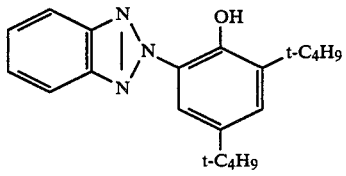

C-2

-continued
C-3
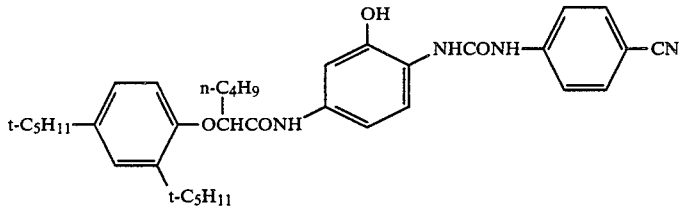
C-4
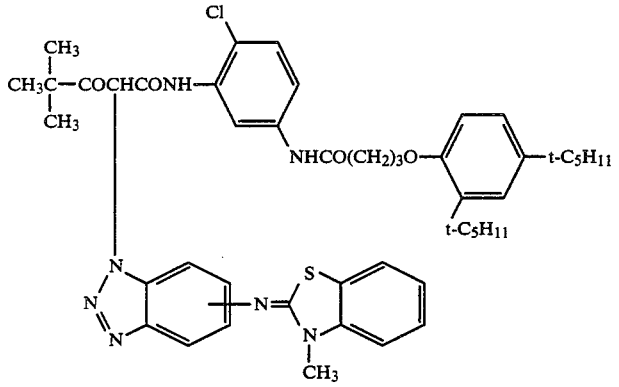
C-5
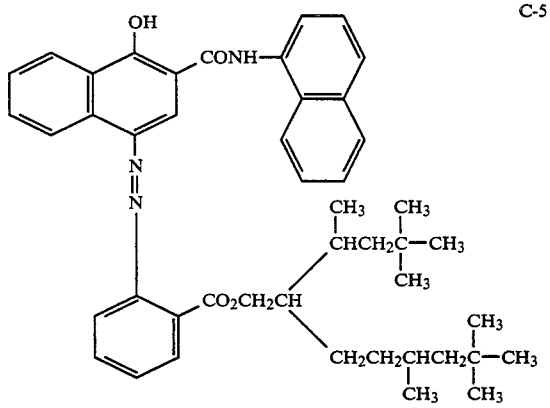
C-6
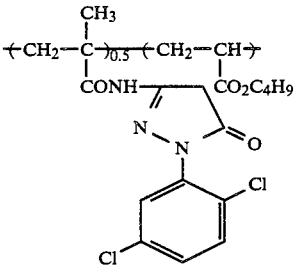
C-7
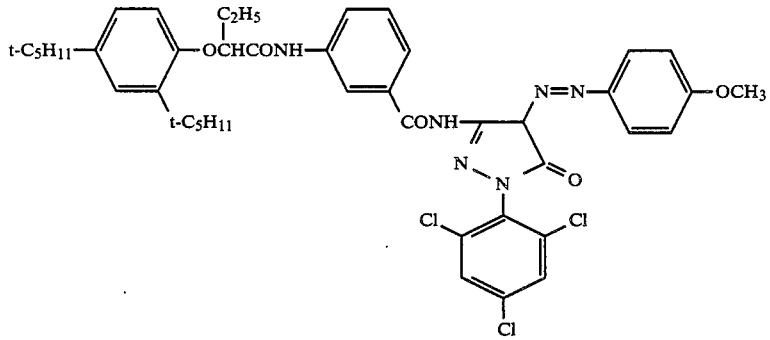

-continued
C-8
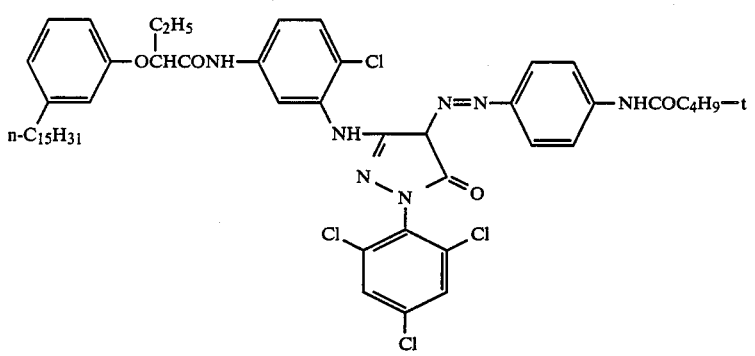
C-9
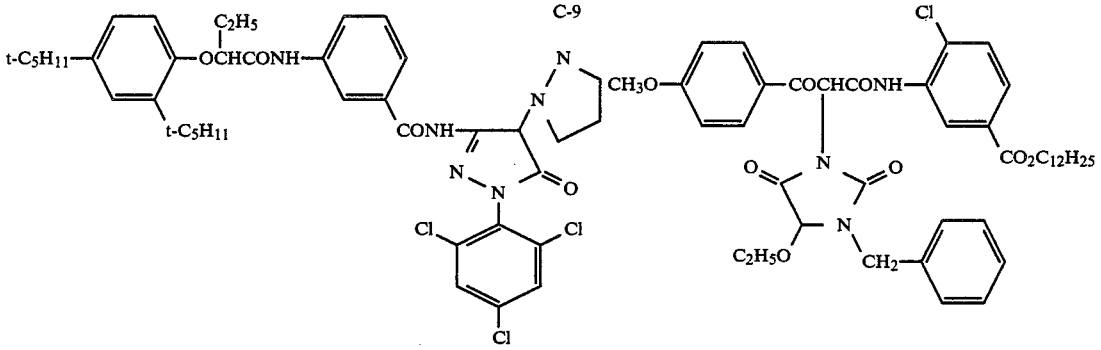
C-10
$(CH_2{=}CHSO_2CH_2CONHCH_2)_2$
C-11
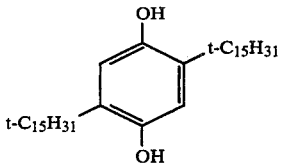
H-1
Sensitizing Dye I
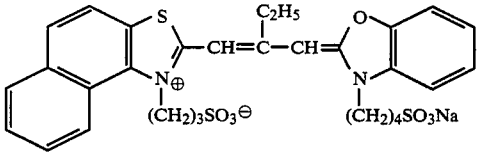
Sensitizing Dye II
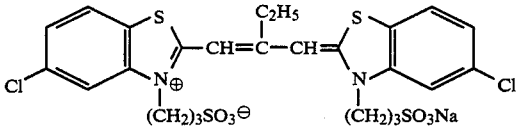
Sensitizing Dye III
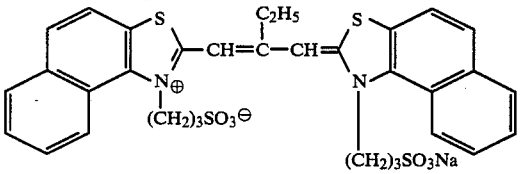
Sensitizing Dye IV
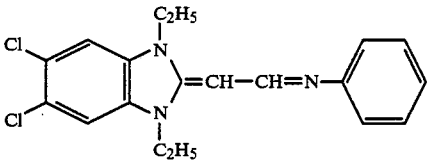
Sensitizing Dye V
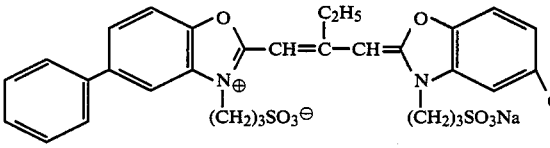
Sensitizing Dye VI
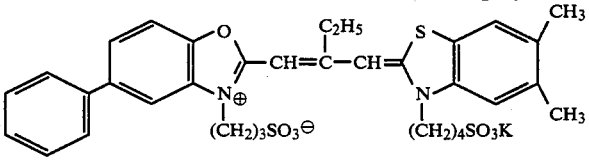

-continued

Sensitizing Dye VII

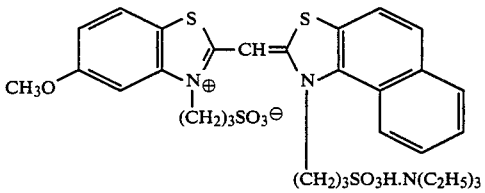

Furthermore, Samples 102 to 109 were prepared by following the same procedure as above except that each of the 1st protective layers containing 25 mole%, 50 mole%, 75 mole%, 100 mole%, 125 mole%, 140 mole%, 150 mole%, and 175 mole% (the amount based on the total AgI in the light-sensitive silver halide emulsion layers, AgI in the halogen composition being all 1 mole%), respectively, of the super fine grain silver halide as used in the 2nd layer was used in place of the 14th layer (1st protective layer) of Sample 101.

Each of Samples 101 to 109 was wedge-exposed to white lamp and processed by the following process. In this case, however, two kinds of fix solutions, i.e., fresh fix solution (A) and fix solution (B) the composition of which became stationary by continuously processing Sample 101 (hereinafter, the fix solution is referred to as continuously processed fix solution).

| Processing Step | Temperature | Time |
|---|---|---|
| Color Development | 41° C. | 3 min. |
| Stop | 38° C. | 30 sec. |
| Wash | " | 30 sec. |
| Pre-bath | " | 30 sec. |
| Bleach | " | 3 min. |
| Wash | " | 1 min. |
| Fix | " | 2 min. |
| Wash | " | 2 min. |
| Stabilization | " | 10 sec. |

The compositions of the processing solutions used for the above processing steps were as follows.

| | |
|---|---|
| Color Developer: | |
| Aminotri(methylenesulfonic acid)-5-sodium salt | 1.5 g |
| Sodium sulfite | 2.0 g |
| Sodium bromide | 1.2 g |
| Sodium carbonate | 26.0 g |
| N—Ethyl-N—β-methanesulfonamidoethyl-3-methyl-4-aminoaniline sesquisulfate monohydrate | 4.0 g |
| Water to make | 1.0 liter (pH adjusted to 10.20) |
| Stop Solution: | |
| Sulfuric acid (7 N) | 50 ml |

-continued

| | |
|---|---|
| Water to make | 1.0 liter |
| Pre-Bath: | |
| Sodium metahydrogensulfite | 10.0 g |
| Glacial acetic acid | 25.0 ml |
| Sodium acetate | 10.0 g |
| Ethylenediaminetetraacetic acid tetra-sodium | 1.0 g |
| Compound (I)-(7) of general formula (I) | 3.0 g |
| Water to make | 1.0 liter |
| Bleach Solution: | |
| Gelatin | 0.5 g |
| Sodium persulfate | 35.0 g |
| Sodium chloride | 15.0 g |
| Sodium primary phosphate | 9.0 g |
| Phosphoric acid (85%) | 2.5 ml |
| Water to make | 1.0 liter |
| Fix Solution (A): | |
| Aminotri(methylenephosphoric acid)-5-sodium salt | 1.5 g |
| Ammonium thiosulfate (58%) | 185.0 ml |
| Sodium sulfite | 10.0 g |
| Sodium hydrogensulfite | 8.4 g |
| Water to make | 1.0 liter |
| Stabilization Solution: | |
| Formaldehyde (37%) | 10 ml |
| Water to make | 1.0 liter |

For each film sample thus processed, the amounts of silver remaining in the un-exposed portions and the maximum density portions of the sample were measured by an X-ray fluometry. The amount of remaining silver did not depend upon the coloring density. The photographic properties and the amount of remaining silver in the un-exposed portions of each sample are shown in Table 1.

In addition, the photographic properties are shown for the blue-sensitive emulsion layers, which were most largely influenced by the super fine silver halide grains in the protective layer.

In FIG. 1, $S_{0.2}$ shows a relative value (defining the case of Sample 101 as 100) of the exposure amount (shown by logarithm) giving a density of Dmin (the minimum image density) +0.2. also, $\overline{G}_{1.5}$ shows a difference between the image density at $S_{0.2}$ and the image density at the exposure amount of the exposure amount at the case +1.5.

TABLE 1

| Sample No. | Super Fine Grain Silver Halide (mole %) | Amount of Remaining Silver ($\mu g/cm^2$) Fix Soln. (A) | Fix Soln. (B) | Photographic Properties of Blue-sensitive Layer Fog | $S_{0.2}$ | $G_{1.5}$ |
|---|---|---|---|---|---|---|
| 101 (Comparison Example) | 0 | 25 | 38 | 0.03 | 100 | 0.50 |
| 102 (Comparison Example) | 25 | 10 | 17 | 0.03 | 107 | 0.52 |
| 103 (Invention) | 50 | 4 | 6 | 0.04 | 112 | 0.54 |
| 104 (Invention) | 75 | 4 | 5 | 0.04 | 118 | 0.55 |

TABLE 1-continued

| Sample No. | Super Fine Grain Silver Halide (mole %) | Amount of Remaining Silver ($\mu g/cm^2$) Fix Soln. (A) | Fix Soln. (B) | Photographic Properties of Blue-sensitive Layer Fog | $S_{0.2}$ | $G_{1.5}$ |
|---|---|---|---|---|---|---|
| 105 (Invention) | 100 | 3 | 5 | 0.05 | 122 | 0.56 |
| 106 (Invention) | 125 | 3 | 4 | 0.06 | 125 | 0.57 |
| 107 (Invention) | 140 | 2 | 3 | 0.07 | 125 | 0.57 |
| 108 (Comparison Example) | 150 | 2 | 3 | 0.07 | 125 | 0.56 |
| 109 (Comparison Example) | 175 | 2 | 3 | 0.07 | 125 | 0.55 |

From the results shown in Table 1, it can be seen that the super fine grain silver halide in the protective layer has a very large effect in reducing the amount of remaining silver caused by insufficient fixing and considering the allowable amount of remaining silver being about 5 $\mu g/cm^2$, the lowest addition amount of the super fine grain silver halide is about 50 mole%, and preferably at least about 75 mole%, of the total AgI in the light-sensitive silver halide emulsion layers. The amount of remaining silver becomes lower with the increase of the addition amount of the super fine grain silver halide, but, on the other hand, the formation of fog is increased and the sensitivity ($S_{0.2}$) reaches a maximum with the increase of the silver halide. Furthermore, $\overline{G}_{1.5}$ tends to decrease. Accordingly, it can be said to be sufficient that the addition amount of the super fine grains silver halide is up to about 140 mole% of the total AgI.

In the case that a bath to which Compound (I)–(7) of the present invention had not been added was used as the pre-bath for the bleaching bath, the amount of the residual silver was large due to a poor bleaching and such a bath could not be practically used.

EXAMPLE 2

Samples 111 to 121 were prepared using the super fine grains silver halides having the mean grain sizes and the halide compositions, respectively, shown in Table 2 for the 1st protective layers (the 14th layer) of Sample 101 in Example 1 and the same experiments as in Example 1 were performed. The results obtained are shown in Table 2 below.

TABLE 2

| Sample No. | Characteristics of Super Fine Grain Silver Halide: Halogen Composition | Mean Grain Size ($\mu m$) | Coated Amount (mole %) | Amount of Remaining Silver ($g/cm^2$) Fix Soln. (A) | Fix Soln. (B) | Photographic Properties of Blue-Sensitive Layer Fog | $S_{0.2}$ |
|---|---|---|---|---|---|---|---|
| 101 (Comparison Example) | — | — | 0 | 25 | 38 | 0.03 | 100 |
| 110 (Invention) | AgBr | 0.07 | 140 | 2 | 2 | 0.08 | 128 |
| 107 (Invention) | $AgBr_{0.99}I_{0.01}$ | " | " | 2 | 3 | 0.07 | 125 |
| 111 (Invention) | $AgBr_{0.98}I_{0.02}$ | " | " | 2 | 4 | 0.06 | 123 |
| 112 (Invention) | $AgBr_{0.97}I_{0.03}$ | " | " | 4 | 5 | 0.06 | 119 |
| 113 (Comparison Example) | $AgBr_{0.96}I_{0.04}$ | " | " | 7 | 8 | 0.05 | 116 |
| 114 (Invention) | AgCl | " | " | 1 | 1 | 0.10 | 130 |
| 115 (Invention) | $AgCl_{0.99}I_{0.01}$ | " | " | 2 | 2 | 0.08 | 127 |
| 116 (Invention) | $AgCl_{0.98}I_{0.02}$ | " | " | 2 | 2 | 0.07 | 125 |
| 117 (Invention) | $AgCl_{0.97}I_{0.03}$ | " | " | 3 | 4 | 0.06 | 120 |
| 118 (Comparison Example) | $AgCl_{0.96}I_{0.04}$ | " | " | 6 | 7 | 0.06 | 117 |
| 119 (Invention) | $AgBr_{0.99}I_{0.01}$ | 0.14 | " | 4 | 5 | 0.06 | 122 |
| 120 (Invention) | " | 0.20 | " | 5 | 6 | 0.05 | 117 |
| 121 (Comparison Example) | " | 0.30 | " | 7 | 9 | 0.05 | 111 |

As is clear from the results shown in Table 2, the AgBr or AgCl increases the fixing speed (the reduction in the amount of remaining silver) and also the sensitivity ($S_{0.2}$) as compared to AgBrI, but increases the formation of fog. When a part of the halogen in AgBr or AgCl is replaced with an iodide ion, the fixing speed gradually becomes lower and when the replacement percentage of the iodine ion is higher than 4 mole%, the amount of remaining silver becomes higher than the level (about 5 $\mu g/cm^2$) of causing problems in practical use. Also, there is an upper limit about the mean grain size of the super fine grain silver halide, and it is preferred that the mean grain size be lower than 0.20 $\mu m$.

EXAMPLE 3

Samples 122 to 124 were prepared in the same manner as in the case of preparing Sample 101, except that the super fine grain silver halide as used for Sample 107 in Example 1 was used for the 6th layer, the 10th layer and 15th layer (the outermost layer) of Sample 101. Sample experiments as in Example 1 were performed on these samples thus prepared, and the results thus obtained are shown in Table 3.

TABLE 3

| Sample No. | Amount of Remaining Silver ($\mu g/cm^2$) Fix Soln. (A) | Fix Soln (B) | Photographic Properties of Blue-Sensitive Layer Fog | $S_{0.2}$ |
|---|---|---|---|---|
| 101 (Comparison Example) | 25 | 38 | 0.03 | 100 |
| 107 (Invention) | 2 | 3 | 0.07 | 125 |
| 122 (Comparison Example) | 25 | 37 | 0.03 | 100 |
| 123 (Comparison Example) | 26 | 39 | 0.25 | 80 |
| 124 (Invention) | 1 | 2 | 0.06 | 122 |

From the results shown in Table 3, it can be seen that when the super fine grain silver halide is incorporated in the 6th layer or the 10th layer, the fixing speed is not improved and in particular, when the super fine grain silver halide is incorporated in the 10th layer, the formation of fog is greatly increased. When the super fine grain silver halide is incorporated in the 15th layer, the fixing speed is improved to some extent although the sensitivity ($S_{0.2}$) becomes somewhat lower.

Thus, it can be seen that the effect of this invention is large when the super fine grain silver halide is incorporated in the outermost layer (protective layer) of a color photographic material, or when the protective layer is composed of two or more layers) in at least one of the protective layers.

EXAMPLE 4

Samples 125 to 133 were prepared by changing the silver coverage of the 14th layer (the 1st protective layer) of Sample 107 and the total AgI amount of the light-sensitive silver halide emulsion layers of Sample 107 to those shown in Table 4 below.

TABLE 4

| Sample No. | Coverage of Super Fine Grains (mole %) | Amount of Total AgI in Light-Sensitive Emulsion Layer ($mole/m^2$) | Amount of Remaining Silver ($\mu g/cm^2$) Fix Soln. (A) | Fix Soln. (B) |
|---|---|---|---|---|
| 103 (Invention) | 50 | $7.37 \times 10^{-3}$ | 4 | 6 |
| 125 (Comparison Example) | 40 | $5.90 \times 10^{-3}$ | 8 | 13 |
| 126 (Comparison Example) | 45 | " | 6 | 7 |
| 127 (Invention) | 50 | " | 4 | 5 |
| 128 (Comparison Example) | 40 | $4.55 \times 10^{-3}$ | 6 | 7 |
| 129 (Invention) | 50 | " | 5 | 5 |
| 130 (Invention) | 60 | " | 4 | 5 |
| 131 (Comparison Example) | 30 | $3.00 \times 10^{-3}$ | 4 | 5 |
| 132 (Comparison Example) | 40 | " | 3 | 4 |
| 133 (Comparison Example) | 50 | " | 2 | 3 |

From the results shown in Table 4, it can be seen that when the coverage of the super fine grain silver halide is not higher than 50% of the total AgI amount on the light-sensitive silver halide emulsion layers, a sufficient fixability cannot be obtained. Also, in the case of color photographic materials wherein the content of AgI in the light-sensitive silver halide emulsion layers thereof is less than about $4.50 \times 10^{-3}$ mole/m$^2$, there is no problem about the fixability when an ordinary amount of the super fine grain silver halide is used.

While the invention has been described in detail and with reference to specific embodiments thereof, it will be apparent to one skilled in the art that various changes and modifications can be made therein without departing from the spirit and scope thereof.

What is claimed is:

1. A method of processing an image-wise exposed silver halide color photographic material having on a support at least one red-sensitive silver halide emulsion layer, at least one green-sensitive silver halide emulsion layer, and at least one blue-sensitive silver halide emulsion layer, the total amount of silver iodide contained in the light-sensitive silver halides in said light-sensitive silver halide emulsion layers being higher than $4.0 \times 10^{-3}$ mole/m$^2$, which comprises processing the color photographic material further containing in a protective layer thereof a super fine grain silver halide, having a mean grain size of less than 0.2 $\mu$m and having a silver iodide content of less than 3 mole%, in an amount of from 50 to 140 mole% of the total amount of silver iodide contained in the light-sensitive silver halides, by a color development process including a step subjecting the material to a compound represented by formula (I)

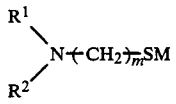

(I)

wherein M represents a hydrogen atom, an alkali metal atom, an alkaline earth metal atom, a quaternary ammonium group, a quaternary phosphonium group, an amidino group, or a group represented by

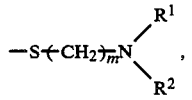

wherein $R^1$ and $R^2$ each represents a hydrogen atom or an aliphatic residue; and m represents an integer of 2 to 4; or a strong acid salt thereof.

2. The method of claim 1, wherein said color development process includes a bleach step using a bleaching solution or a blix step using a blixing solution wherein the material is subjected to a weak bleaching agent.

3. The method of claim 2, wherein the weak bleaching agent is a ferric ion complex salt or a persulfate.

4. The method of claim 2, wherein the weak bleaching agent is a persulfate.

5. The method of claim 2, wherein the compound of formula (I) is present in the bleaching solution or the blix solution.

6. The method of claim 2, wherein the compound of formula (I) is present in a pre-bath for the bleaching step or the blix step.

7. The method of claim 1, wherein the silver iodide content is less than 2 mole%.

8. The method of claim 2, wherein the silver iodide content is less than 2 mole%.

9. The method of claim 5, wherein the silver iodide content is less than 2 mole%.

10. The method of claim 1, wherein the protective layer contains super fine grain silver halide in an amount of from 75 to 140 mole% of the total amount of silver iodide contained in the light-sensitive silver halide.

11. The method of claim 2, wherein the protective layer contains super fine grain silver halide in an amount of from 75 to 140 mole% of the total amount of silver iodide contained in the light-sensitive silver halide.

12. The method of claim 5, wherein the protective layer contains super fine grain silver halide in an amount of from 75 to 140 mole% of the total amount of silver iodide contained in the light-sensitive silver halide.

13. The method of claim 7, wherein the protective layer contains super fine grain silver halide in an amount of from 75 to 140 mole% of the total amount of silver iodide contained in the light-sensitive silver halide.

14. The method of claim 1, wherein the compound represented by formula (I) is present in a processing solution in an amount of from $1\times10^{-5}$ to 1 mole per liter of the processing solution.

15. The method of claim 2, wherein the compound represented by formula (I) is present in a processing solution in an amount of from $1\times10^{-5}$ to 1 mole per liter of the processing solution.

16. The method of claim 5, wherein the compound represented by formula (I) is present in the bleaching or blix solution in an amount of from $1\times10^{-5}$ to 1 mole per liter of the bleaching or blix solution.

17. The method of claim 7, wherein the compound represented by formula (I) is present in a processing solution in an amount of from $1\times10^{-5}$ to 1 mole per liter of the processing solutions.

18. The method of claim 10, wherein the compound represented by formula (I) is present in a processing solution in an amount of from $1\times10^{-5}$ to 1 mole per liter of the processing solution.

* * * * *